United States Patent [19]

Halstad

[11] 4,307,476

[45] Dec. 29, 1981

[54] DEVICE FOR PREVENTING CLOGGING OF MAIN SEWER LINES

[76] Inventor: Owen M. Halstad, 1486 Friendly Rd., Pasadena, Md. 21122

[21] Appl. No.: 212,317

[22] Filed: Dec. 3, 1980

[51] Int. Cl.[3] ..... A47K 17/00; E03D 11/00

[52] U.S. Cl. ..... 4/661; 4/257; 4/255

[58] Field of Search ..... 4/257, 661, 255, 256

[56] References Cited

U.S. PATENT DOCUMENTS

| | | | |
|---|---|---|---|
| 594,169 | 11/1897 | Catsiff | 4/257 |
| 1,886,676 | 11/1932 | Heuacker | 4/257 X |
| 2,693,603 | 11/1954 | Lehmann | 4/257 |
| 2,811,724 | 11/1957 | Click et al. | 4/257 |
| 3,872,521 | 3/1975 | Friedman | 4/257 X |
| 4,253,211 | 3/1981 | Mockel | 4/257 X |

*Primary Examiner*—Henry K. Artis

*Attorney, Agent, or Firm*—Isler and Ornstein

[57] ABSTRACT

A device is disclosed for preventing clogging of main sewer lines by containing a potential back-up at the source, namely, the toilet. The device comprises an expansible annular member or ring which is adapted for placement adjacent the discharge tube at the base of the toilet, and is provided with circumferentially-spaced hook-like members which extend upwardly into the discharge tube and are so designed and arranged as to shred or catch material which has been improperly disposed of in the toilet, and without interfering with the normal use of the toilet to eject waste.

8 Claims, 4 Drawing Figures

DEVICE FOR PREVENTING CLOGGING OF MAIN SEWER LINES

BACKGROUND OF THE INVENTION

This invention relates to a device for preventing clogging of main sewer lines by containing a potential back-up at the source, namely, the toilet.

A common problem, particularly in multiple dwelling unit structures, such as apartments, condominiums and the like, is that of the main line back-up. This occurs when an occupant of a unit passes items, such as sanitary napkins, disposable diapers, articles of clothing and the like through the toilet. These items either by themselves or in conjunction with others, can cause a stoppage which will have a negative effect on all units in the building and can be very costly and time consuming to repair.

In the Hoffman U.S. Pat. No. 2,598,543, a guard for toilet bowls is disclosed, comprising a screen of wire mesh contoured to fit inside the toilet bowl and supported on the bowl in several ways. The screen is designed to prevent the flushing down into the passages of the bowl of foreign bodies accidentally thrown into the bowl, but permits free passage of water.

In the Lehmann U.S. Pat. No. 2,693,603, several forms of an article catch device for outflow passages of toilet bowls are disclosed.

In the Click U.S. Pat. No. 2,811,724, a toilet bowl guard is disclosed which is adapted to be clamped to the front wall of the bowl and is provided with prongs which extend into the bowl and are adapted to engage a fabric article should said article enter the bowl.

In the Beer U.S. Pat. No. 3,208,920, a debris collector is disclosed for fluid receptacle outlets of various sizes, which comprises a support structure in the form of a long narrow strip shaped as a series of arcs, with triangular indentations in between and barbs formed integrally with the strip.

While the devices of the foregoing patents serve the purposes for which they have been designed, they are objectionable for various reasons, including the following:

(a) The Hoffman screen is located at a level near the rim of the toilet bowl and thus may catch fecal matter deposited upon the screen, and cause such matter to splash upwardly. Moreover, the screen itself has a large area such as to interfere with passage of both fecal matter and water therethrough. The device is also easily accessible to occupants of the apartment in which the device is installed enabling it to be easily removed.

(b) The devices of the Lehmann patent are so located in the bowl as to render them difficult to place in the bowl and maintain them in proper position. Moreover, the devices do not have a sufficient number of prongs to insure retention thereby of articles passing through the device. Furthermore, the devices are easily accessible and thus can be easily removed.

(c) The device of the Click patent has the same shortcomings as the devices of the Lehmann patent.

(d) In the device of the Beer patent, the construction is such as to render it difficult to install in a toilet bowl or other waste outlet, and the barbs or spikes are so located as to render them inefficient in catching articles. Moreover, the devices cover an area such as to inhibit the flow of water therethrough.

BRIEF DESCRIPTION OF THE DRAWINGS

The present invention may be better understood and the numerous objects and advantages will become apparent to those skilled in the art by reference to the accompanying drawings, wherein like reference numerals refer to like elements or parts in the various figures and in which.

SUMMARY OF THE INVENTION

The invention has as its principal object the provision of a device for preventing clogging of the main sewer lines, which device is relatively simple to construct, easy to install and which, in no way, interferes with the normal use of the toilet.

Another object of the invention is to provide a device of the character described, which is readily adaptable for use in connection with any of the standard or present day toilet bowls without any changes in the bowls or sewer connections from the bowls.

A further object of the invention is to provide a device of the character described which can be quickly and easily installed and removed by maintenance personnel of the building, while inhibiting access to the device by occupants of the units and unauthorized persons.

The foregoing and other objects of the invention and the manner of attaining them will become more apparent and the invention itself will be best understood by reference to the following description of an embodiment of the invention, taken in conjunction with the accompanying drawings.

DESCRIPTION OF A PREFERRED EMBODIMENT

Figure 1:
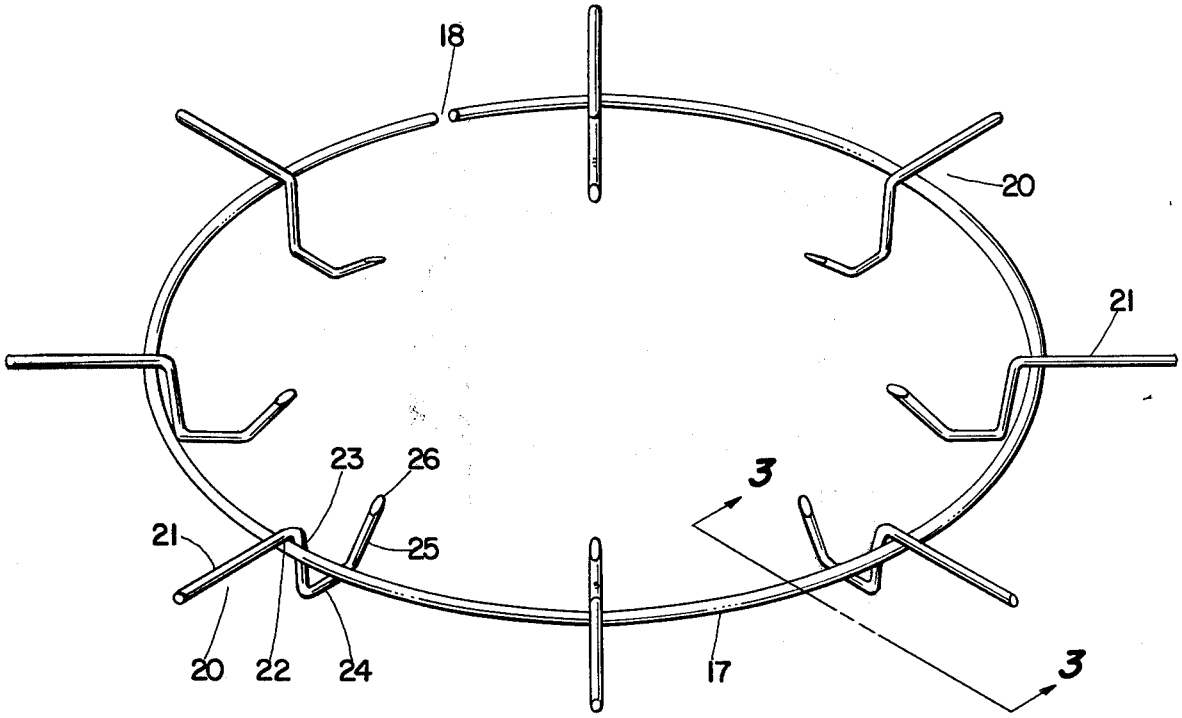
FIG. 1 is an isometric or perspective view of the device or "back-up preventer", as I term it, embodying the invention.
Figure 2:
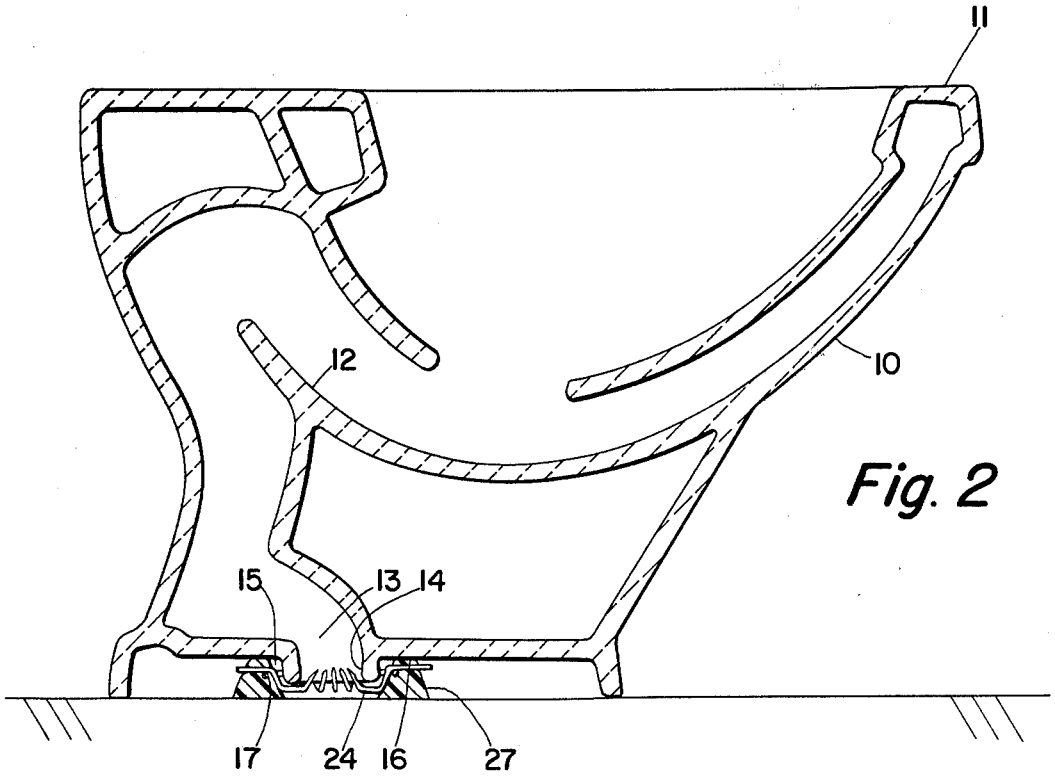
FIG. 2 is a cross-sectional view of a toilet bowl with the device of the invention installed therein.
Figure 3:
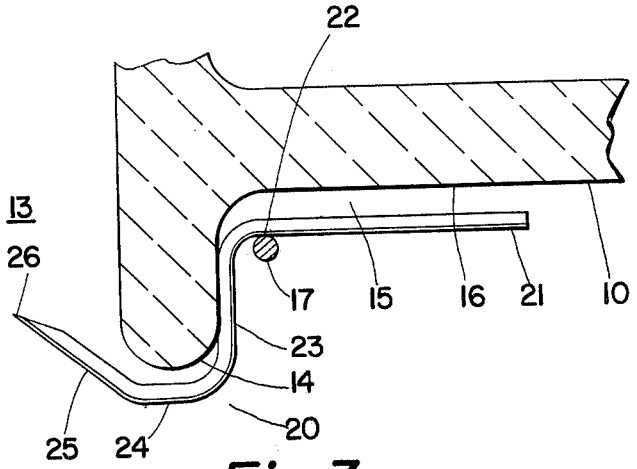
FIG. 3 is a fragmentary cross-sectional view on an enlarged scale, taken on the line 3—3 of FIG. 1, and showing the manner in which the device is connected to the discharge tube or outlet of the toilet bowl.

Referring more particularly to the drawings and especially to FIGS. 2 and 3, a conventional toilet bowl 10 is shown having a seat rim 11, a siphon passage or outflow channel 12 and a downflow channel or passageway 13.

The channel or passageway 13 is defined at its lower end by a flange 14 of tubular configuration, which may be referred to as a discharge tube or outlet.

The area of the bowl 10 which is radially outwardly of the flange 14 or discharge tube, provides an annular space 15, the base or upper wall of which is designated by reference numeral 16.

The device of the present invention, as best seen in FIGS. 1, 2, 3 and 4, comprises an annular member or ring 17, made of non-ferrous wire or the like, and split as at 18, for a purpose to be presently described.

In practice, the annular member or ring 17 is approximately $4\frac{1}{2}''$ in diameter.

Secured to the annular member or ring 17, at circumferentially-spaced points, is a series of hook-like members made of wire and each of which is designated generally by reference numeral 20, there being eight of such members in the device as illustrated.

Each of the members 20 consists of a straight portion 21, which extends radially of the annular member or ring 17 and is welded to the ring, as at 22, a downwardly extending straight portion 23, which extends substantially perpendicularly to the portion 21, an inwardly extending straight portion 24 which lies in substantially parallel relation to the portion 21 and a straight terminal portion or hook 25 which extends inwardly from the inner end of the portion 24, at an angle of approximately 45° to the portion 24, and terminates in a point 26.

It may be further noted that each of the members 20 lies in a plane, which is diametric to the ring 17 and perpendicular to the plane of the ring.

Figure 4:
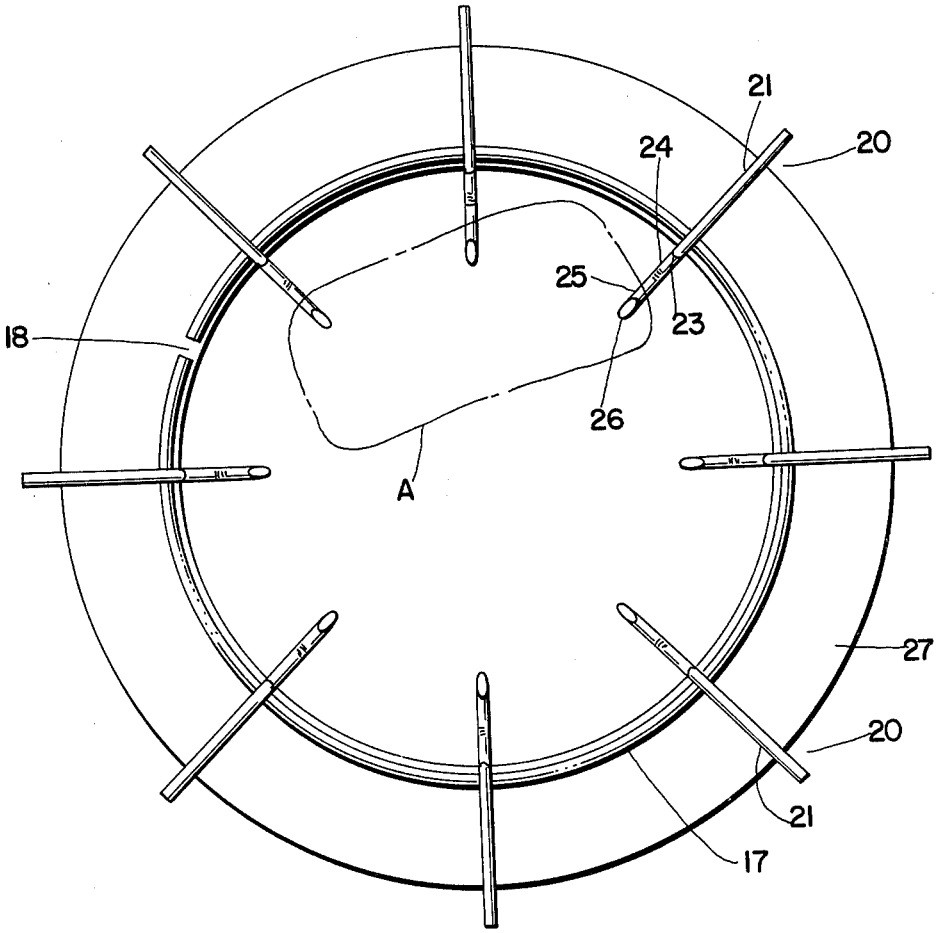
FIG. 4 is a top plan view of the device showing a wax ring on which the device is mounted in the course of its installation on a toilet bowl.

The device, consisting of the ring 17 and the members 20, is installed in the toilet bowl 10 in the manner shown in FIGS. 2, 3 and 4.

For this purpose the portions 21 of the device are embedded in a wax ring 27 which is slightly larger in diameter than the diameter of the ring 17, and is designed to fit into the annular space 15 of the toilet bowl to which reference has been made. The function of the wax ring will be presently explained.

The assembly of the device and the wax ring is mounted on the toilet bowl in the manner shown in FIG. 2 by lifting the toilet bowl from the floor, inserting the device and wax ring into the space 15, and then bolting or otherwise securing the toilet bowl to the floor. This method of installation of the device does not appreciably increase the time of installation of the toilet.

In thus installing the device, the ring 17 contracts to cause the portions 23 of the members 20 to resiliently engage the outer wall of the flange or discharge tube 14, as best seen in FIG. 3, and the terminal portions 25 and their points 26 of the members 20 extend into the passageways 13 and act as shredders as well as a snare to catch material which has been improperly disposed of, and thus prevents clogging of the main sewer lines, without interfering with the normal use of the toilet. In FIG. 4, an article A, shown in broken-lines, is seen as snared or caught by the members 20.

When a toilet is flushed, water washing around inside of the toilet bowl causes the waste to be similarly flushed. A vortex is formed in the bowl and is maintained in the bowl as the waste leaves the bowl and enters the drain pipe. Since the waste spins along the walls by which it is confined, it passes through the device, where its potential to cause a back-up is determined. The device permits the flushing action of the toilet to reach its peak, without hindering flushing of acceptable waste in any way.

The design of the hooks and their arrangement around the toilet discharge tube renders it virtually impossible for anything to pass out of the toilet without coming in contact with the hooks. The sharp points of the hooks shred toilet tissue, but also act as hooks to catch undesirable material and prevent it from entering the sewer lines.

The wax ring 27 functions to seal the toilet against leakage into the space 15 that is to say, to prevent leakage between the flange 14 and the sewer line into which fluid in the passageway 13 discharges.

The split 18 in the ring 17 permits the device to be expanded to fit different diameters of the flange 14.

Although the device has been described as made of wire parts, it is to be understood that it may be made in one piece, by casting or stamping.

Moreover, it may be made of material other than metal, as for example, plastic fibers or other acceptable material.

It is thus seen that I have provided a device of the character described which is admirably adapted for the prevention of clogging of the main sewer lines to which a toilet is connected, which is relatively simple to construct, easy to install, and which, in no way, interferes with the normal use of the toilet.

It is also seen that I have provided a device of the character described which is readily adaptable for use in connection with any of the standard or present day toilet bowls, without any changes in the bowls or sewer connections from the bowls.

It is further seen that I have provided a device of the character described which can be quickly and easily installed and removed by maintenance personnel of the building, while inhibiting access to the device by occupants of the units and unauthorized persons.

It is to be understood that the form of my invention herewith shown and described, is to be taken as a preferred example of the same and that various changes may be made in the shape, size and arrangement of parts thereof, without departing from the spirit of the invention or the scope of the subjoined claims.

Having thus described my invention, I claim:

1. In combination with a toilet bowl or the like having a substantially vertical discharge outlet at its bottom defined by an annular flange or tube, a device for preventing clogging of sewer lines into which fluid passing through said outlet is discharged, said device comprising an annular member secured to said flange and disposed outwardly of said flange and having a diameter greater than the external diameter of said flange, said member having circumferentially-spaced hooks extending into said discharge outlet, said hooks lying in vertical planes which are perpendicular to the plane of said annular member.

2. The combination as defined in claim 1, wherein each of said hooks has a straight portion extending substantially radially outwardly from said annular member, a downwardly extending straight portion extending substantially perpendicularly to said first straight portion, an inwardly extending portion underlying said annular flange and substantially parallel to said first-named straight portion, and a terminal portion extending angularly to said inwardly extending portion extending toward the axis of said annular member and terminating in a point.

3. The combination as defined in claim 2, wherein said annular member resiliently engages said flange.

4. The combination as defined in claim 3, wherein said annular member is split at a point in its circumference.

5. The combination as defined in claim 4, including a wax sealing ring underlying said first-named straight portion of said hook.

6. A device for preventing clogging of a sewer line into which fluid passing from a toilet bowl at the bottom of the bowl is discharged, said bowl having a substantially vertical tube at the bottom of the bowl through which said fluid passes to said sewer line, said device comprising an annular member secured to and disposed outwardly of said tube, said member having circumferentially-spaced hooks which extend internally of said annular member and which lie in vertical planes which are perpendicular to the plane of said annular member.

7. A device as defined in claim 6, wherein each of said hooks has a straight portion, extending substantially radially outwardly from said annular member, a downwardly extending straight portion extending substantially perpendicularly to said first straight portion, an inwardly extending portion substantially parallel with said first straight portion, and a terminal portion extending angularly to said upwardly extending portion and toward the axis of said annular member and terminating in a point.

8. A device as defined in claim 7, wherein said annular member is split at a point in its circumference.

* * * * *